US006168120B1

(12) United States Patent
Pease

(10) Patent No.: US 6,168,120 B1
(45) Date of Patent: Jan. 2, 2001

(54) OPERATOR FOR A RAILROAD IMPLEMENT

(75) Inventor: Ronald Pease, Hickory Hills, IL (US)

(73) Assignee: Western-Cullen-Hayes, Inc., Chicago, IL (US)

( * ) Notice: Under 35 U.S.C. 154(b), the term of this patent shall be extended for 0 days.

(21) Appl. No.: 09/166,381

(22) Filed: Oct. 5, 1998

(51) Int. Cl.[7] ..... B61L 1/00

(52) U.S. Cl. ..... 246/405; 74/97.1; 246/412; 246/413; 246/414; 246/393

(58) Field of Search ..... 246/405, 407, 246/412, 413, 414; 74/106, 2, 97.1, 54, 89.15, 569

(56) References Cited

U.S. PATENT DOCUMENTS 5,052,642 * 10/1991 Peters ..... 246/393
5,375,796 * 12/1994 Turner et al. ..... 246/257
5,775,647 7/1998 Wyatt .
5,809,833 * 9/1998 Newport et al. ..... 74/89.15

* cited by examiner

*Primary Examiner*—S. Joseph Morano
*Assistant Examiner*—Frantz Jules
(74) *Attorney, Agent, or Firm*—Banner & Witcoff, Ltd.

(57) ABSTRACT

An operator for a railroad implement is provided with a linkage which mechanically isolates an actuator from impact forces transmitted through the linkage. Isolation provided by the linkage permits the use of a low power actuators which easily lend themselves to complete energization from solar energy sources. The operator is also provided with a safety electric interlock to prevent energization of the actuator during manual operation. A spring assembly tool is incorporated into the operator housing to facilitate installations and removal of compression springs in the operator mechanism.

22 Claims, 6 Drawing Sheets

OPERATOR FOR A RAILROAD IMPLEMENT

BACKGROUND OF THE INVENTION

This invention relates generally to operators for railroad implements, such implements including derails and switches. Specifically, the invention relates to actuating mechanisms and safety features for operators for railroad implements.

Railroad implements, such as derails and switches, typically require automatic operators for facilitating movement thereof. Such operators provide the driving force for moving the railroad implement, which is usually rather massive, between an engaged and disengaged position. In the case of a derail, the engaged position is characterized by the derail being disposed above the railroad track so as to engage and derail the wheel of an oncoming railcar. In the disengaged position, the derail is positioned adjacent the track and out of the path of the wheels of the railcar.

Many different types of operators are known. For example, as exemplified in U.S. Pat. No. 5,775,647 to Wyatt, an operator for a railroad switch may include a hydraulic actuator that is driven by hydraulic pressure which may be provided by a hydraulic pump. The pump may be partially energized by solar power. Such prior art operators are characterized by a direct link between the actuator and the railroad implement. As a result, impact forces experienced by the railroad implement, for example, when the implement moves to its engaged position, may be transmitted back to the actuator, thereby resulting in damage to and/or excessive wear on the actuator. Such operators therefore require rather robust and expensive actuators that can withstand such impact forces. It would therefore be desirable to provide an operator in which the actuator is isolated from impact forces, such as those that may be generated by movement or engagement/disengagement of the railroad implement or by impact forces originating within the operator itself.

Hydraulic systems such as the one disclosed in U.S. Pat. No. 5,775,647 typically consume large amounts of energy to operate. These energy requirements may render such hydraulic actuating systems unfeasible as a means to provide dependable low power operation, as might be required if solar energy is desired to be the sole source of power for the operator. As a result, operators that incorporate these hydraulic systems cannot rely on solar power as the sole means for providing energy to the operator. Rather, such operators require supplemental energy sources, such as hydraulic rail pumps actuated by the wheels of a passing train, to ensure dependable operation. Since there is a desire in the industry for operators which provide for maximal use of and sole reliance on inexpensive energy sources, such as solar power, it would also be desirable to provide an operator with a low power actuator that permits energization using only solar power, without the need for supplemental energy sources.

There is also needed an operator with improved safety features for manual operation. It is known to provide for manual operation of automatic operators. Such configurations provide for the use of a manual hand lever, actuated by a human operator to move the railroad implement between the engaged and disengaged positions. Incorporating manual features on automatic operators may present a hazard to human operators because there is potential for accidental energization of the actuator while the human operator is attempting to manually operate the railroad implement. These consequences can have catastrophic results and may result in serious injury. It would therefore be desirable to provide an automatic operator that has manual features with improved safety features that would prevent injury to a human operator during manual operation.

There is also needed an improved operator which provides for easy on-site assembly, maintenance or repair. Many operating mechanisms, including the one disclosed in U.S. Pat. No. 5,775,647, rely on compressed spring members to provide a locking mechanism or to store energy to later be used to provide momentum or power to move the railroad implement. Such springs or biasing elements make assembly and repair of the operator difficult because spring installation typically requires compression of the springs and the application of large forces, sometimes on the order of 150 pounds or more. It would therefore be desirable to provide that a railroad operator provides for the easy and safe installation and removal of spring members which are used in the operator assembly.

SUMMARY OF THE INVENTION

The aforementioned problems and others are solved by the present invention which, in a preferred embodiment, provides an operator incorporating a linkage that isolates the actuator from impact forces. The actuator is adapted to rotate a cam shaft with cams that selectively engage the linkage. In a preferred embodiment, the linkage may take the form of a spring biased toggle which is provided with a pair of tapered rollers to engage respective cams on the cam shaft. Spring elements in a biasing assembly bias the toggle into one of first and second positions and assist rotation of the linkage and movement of the implement without contact from the cam. When the implement moves into its engaged position, the linkage is not in contact with the cam. Thus, impact forces are not transmitted back to the cam, camshafts or actuator. Adjustable stop members may be provided on the toggle to limit its movement. First and second stop positions of the toggle are defined by contact of the adjustable stop members with a stop block that is formed on the operator case.

In accordance with another primary aspect of the invention, the aforementioned isolation permits the operator to be provided with a low power, low-cost actuator, for example, a ball screw driven by an electric motor through a reduction gear assembly. Because the actuator need not be constructed to withstand impact forces transmitted through the linkage, low power actuators suitable for energization using only solar power without the need for hard wiring or supplemental energy sources, may be incorporated into the operator. Alternatively, in accordance with this same aspect of the present invention, a low cost and low power hydraulic actuator may be provided In accordance with another primary aspect of the invention, the operator is provided with an electric interlock for a hand lever. The hand lever is stored on the battery and controller pack which is provided with a bracket assembly that includes a micro switch engaged by the stored hand lever and in electrical communication with the electric circuit that provides power to the actuator. Removal of the hand lever from the bracket opens the power circuit and prevents accidental energization of the actuator. Thus, the present invention ensures that the actuator will not be energized when a human operator is manually operating the operator using the hand lever.

In accordance with another primary aspect of the invention, a spring assembly tool is provided on the case of the operator so as to assist a technician in installing or removing the compression springs utilized in the operator biasing assembly. In a preferred embodiment, the spring assembly tool includes an angled bracket mounted to the case and an extendable element, such as a threaded fastener extending through the angled bracket and adapted to engage the biasing assembly. When the biasing assembly is moved to an appropriate position, rotation of the extendable member results in compression of the springs to thereby permit an operator to safely assemble or disassemble the biasing assembly.

BRIEF DESCRIPTION OF THE DRAWINGS

The accompanying drawings which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. Appendix A includes 6 sheets of detailed assembly technical drawings which are intended to form a part of this specification in addition to the following Figures described herein in which.

DETAILED DESCRIPTION OF THE INVENTION

Figure 1:
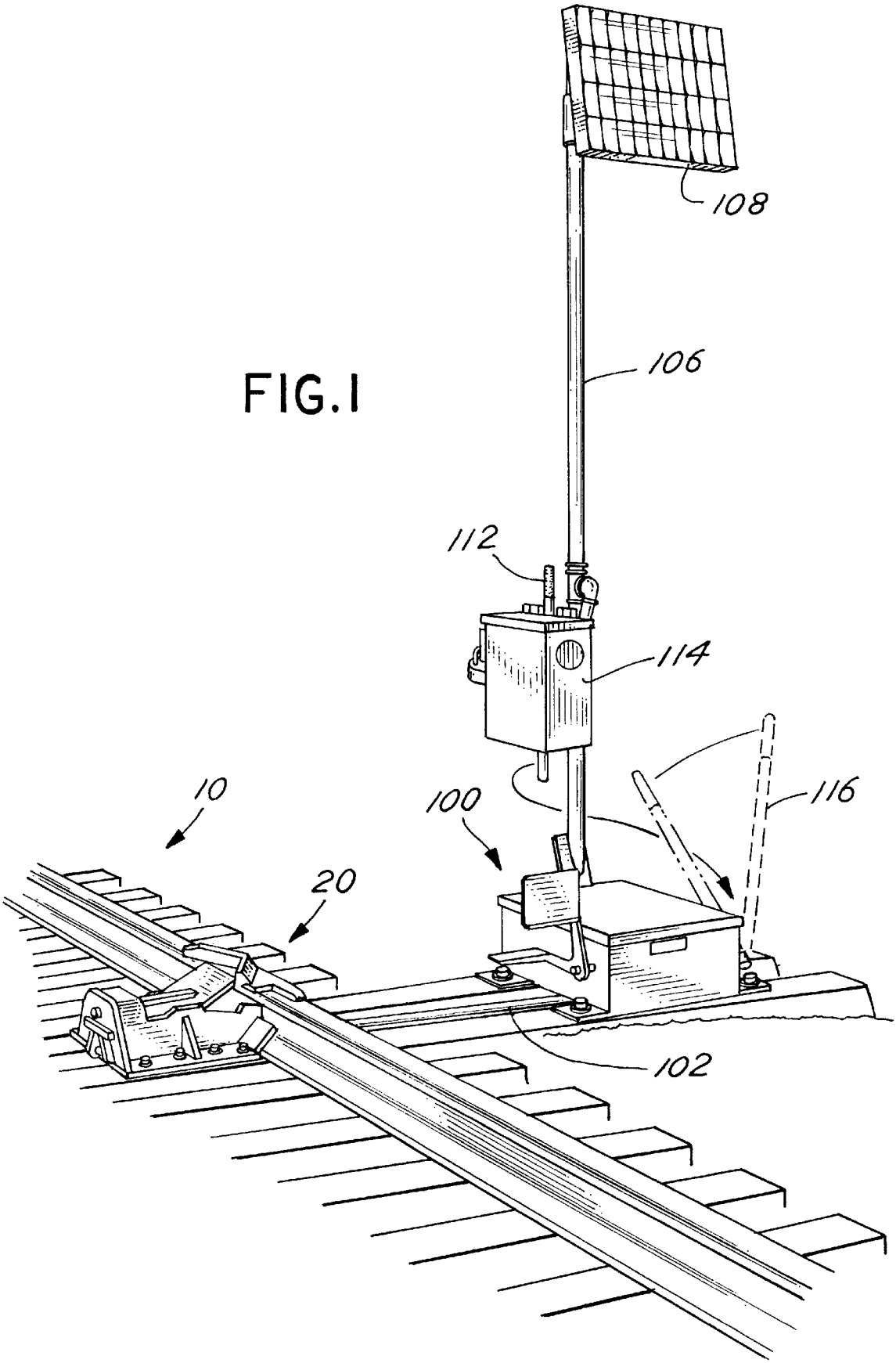
FIG. 1 is an isometric illustrating the environment of an operator according to a preferred embodiment of the present invention.

Referring to FIG. 1, there is shown an operator 100 according to a preferred embodiment of the present invention. Operator 100 is situated adjacent railway 10 which includes a number of railroad ties and two rails, the operator 100 being secured to the ties via spikes and brackets. A railroad implement 20 is operatively associated with the operator 100 connecting rod 102 which extends from operator 100 to railroad implement 20 for moving the implement 20 from an engaged to a disengaged position. Implement 20, which is illustrated as a derail, is shown in an engaged position in FIG. 1. Operator 100 has a mast 106 extending upward therefrom. Mast 106 is provided on a distal end with a solar module 108 for converting solar power or solar energy into electrical energy for use by operator 100. Mast 106 houses electrical conductors to provide energy from solar module 108 to operator 100. Disposed on mast 106 is a battery and controller pack 114 which houses a storage battery (not shown) as well as conventional control components for remotely controlling operator 100 from an oncoming rail vehicle, for example. A hand lever 112 is secured to the back of battery and controller pack 114. As illustrated by the dotted lines 116, hand lever may be moved to an operating position so as to manually permit a user to manually actuate the operator 100.

Figure 2:
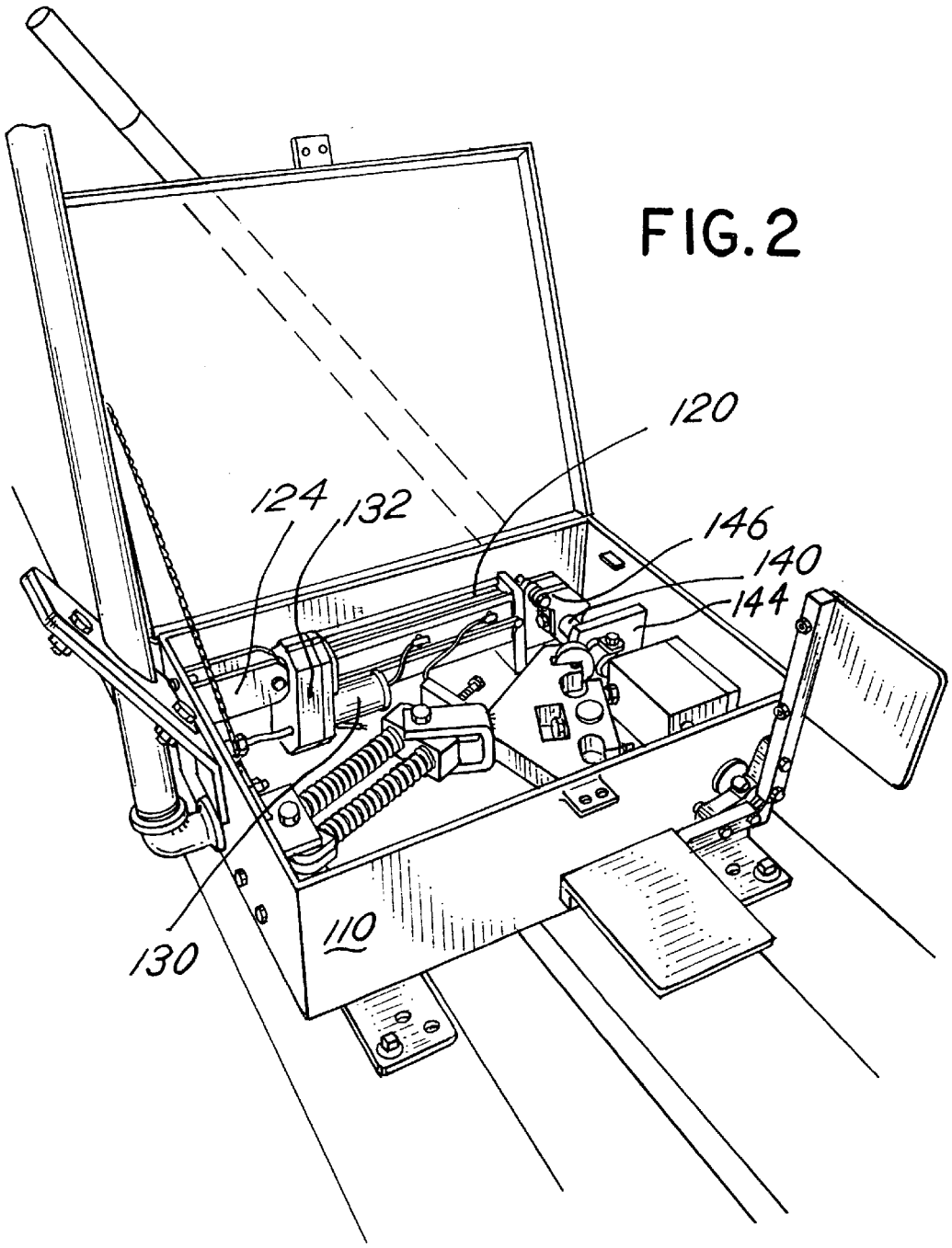
FIG. 2 is an isometric depicting the elements of an operator according to the present invention.

Referring additionally to FIG. 2, the internal components of operator 100 are illustrated. A low power actuator 120 is situated within a case 110. One end of the actuator 120 is secured to an inside surface of case 110 via a mounting bracket 124. According to the present invention, actuator 120 is provided in the form of a ball screw, such as Model No. D12-20B72-06CC manufactured by Warner Electric Inc. As will be apparent to those of ordinary skill in the art, the ball screw includes a threaded internal member which rotates within a race having a number of ball bearings situated therein. Rotational motion of the threaded internal member results in extension of the ball screw. The motive force for driving the screw member is provided by an electric motor 130, which may rotate the threaded internal member through a reduction gear assembly 132. Alternatively, actuator 120 may be provided as a low power hydraulic actuator. An end of actuator 120 opposite the end connected to mounting bracket 124 cooperates with a cam shaft 140, which is provided with a cam shaft crank 146 such that extension or retraction of actuator 120 results in rotation of cam shaft 140.

Figure 3:
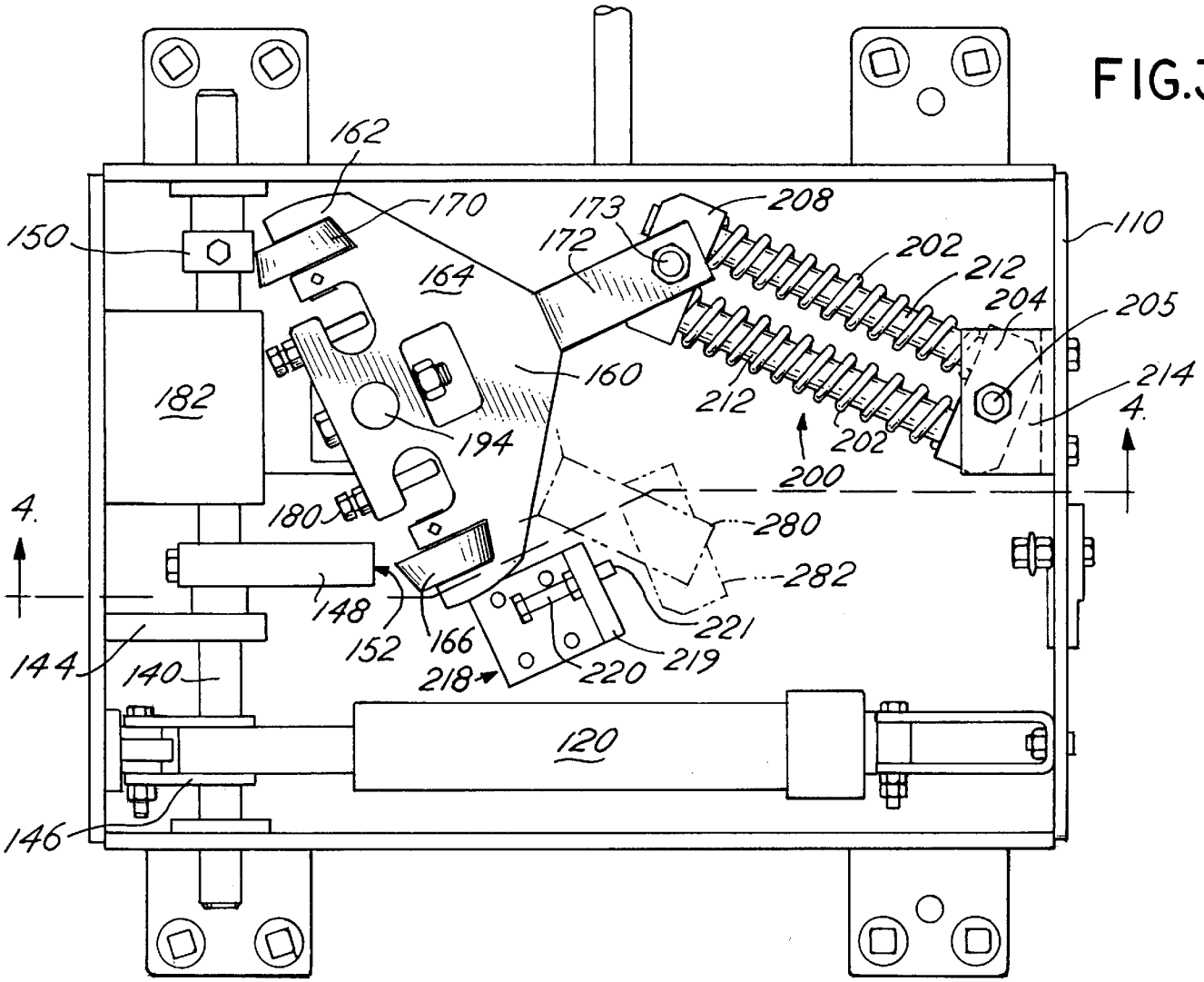
FIG. 3 is a view of the internal working components of an operator according to a preferred embodiment of the present invention.
Figure 4:
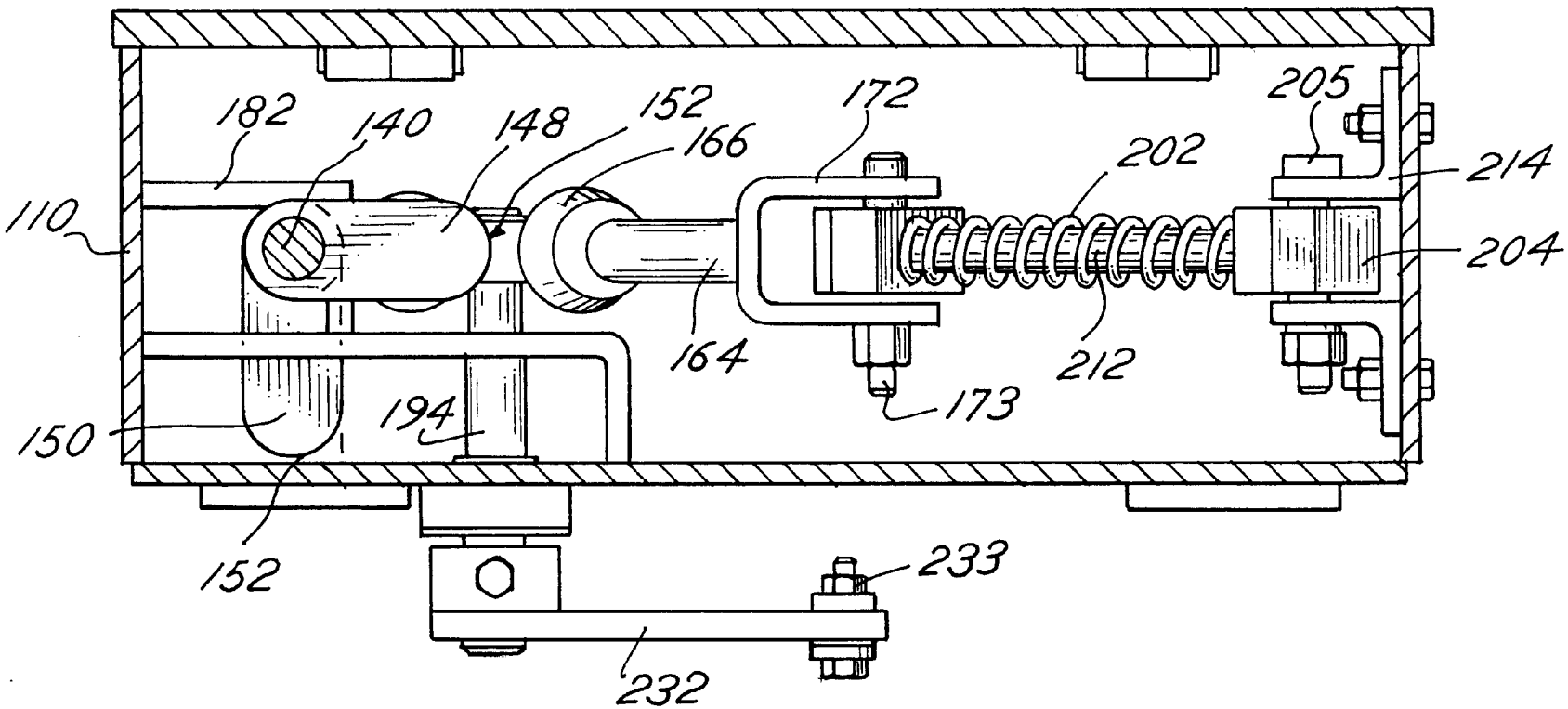
FIG. 4 is a cross-sectional view taken along lines 4—4 in FIG. 3.

Cam shaft 140 may be mounted within a series of journals or bushings 144 which are situated on the interior of case 110. Referring additionally to FIGS. 3 and 4, cam shaft 140 is provided with a first cam 148 fastened thereto and a second cam 150 fastened thereto. Both first cam 148 and second cam 150 are provided with rounded outer surfaces 152 to engage linkage 160, which will be described below. First cam 148 and second cam 150 may be secured to the cam shaft 140 by a threaded fastener for example. As illustrated, the first cam is fixed to cam shaft 140 to extend 90° or orthogonal to the longitudinal extent of second cam 150.

Linkage 160 is secured to a main shaft 194 and mounted for pivotal movement within case 110. Linkage 160 is preferably in the form of a toggle which comprises a generally triangular shaped body 164, which includes a pair of forks 162 adapted to pivotally secure a first roller 166 and a second roller 170 to body 164. First roller 166 and second roller 170 are provided with tapered surfaces, the angle of the taper being chosen to maximize the engagement surface with respective cam elements previously described. As can be seen best in FIG. 3, first roller 166 is adapted to engage outer surface 152 of first cam 148 and second roller 170 is adapted to engage the outer surface 152 of second cam 150. Linkage 160 is provided with a pair of stop bolts 180 disposed on opposite sides of main shaft 194. The function of stop bolts 180 is to limit the pivotal movement of the linkage 160. As can be seen in FIG. 3, the heads of stop bolt 180 are positioned to engage a stop block 182 which is cast, formed integrally or fastened to the case 110. Extending opposite forks 162 is a toggle arm 172 which is provided with a pivot 173 at a distal end thereof. Secured to toggle arm 172 via pivot 173 is a biasing assembly 200 which functions to bias the linkage 160 towards the first and second stop positions defined by stop bolts 180.

Biasing assembly 200 includes a first spring retainer block 204 fastened to pivot 205 via bracket 214 extending from and fixed to case 110. Extending from spring retainer block 204 are a pair of spring rods 212, movably received in apertures in spring rod guide 208. Spring rod guide 208 is pivotably fastened to toggle arm 172 via pivot 173. Disposed around the outer circumference of the spring rods 212 are compression springs 202 whose ends abut respective surfaces on spring rod guide 208 and spring retainer block 204. As will be apparent to those of ordinary skill, biasing assembly 200 is constructed to provide a biasing force in the axial direction of springs 202 and spring rod guides 208. Thus, as the distance between the pivot 173 disposed at the distal end of toggle arm 172 and the pivot 205 extending through the bracket 214 is reduced, the compressive forces in springs 202 increase. Biasing assembly 200 therefore operates to bias linkage 160 in the first position, shown in solid lines in FIG. 3, or in the second position which is shown by dotted lines 280 in FIG. 3.

A main shaft 194 extends downward, as shown in FIG. 4, through the case 110 and is provided with a main shaft crank 232 on a distal end thereof. Main shaft crank 232 is provided with a fastener 233 at an end opposite the main shaft so that a connecting rod (not shown in FIGS. 3 or 4) may be secured thereto so as to actuate the railroad implement.

Automatic operation of the operator 100 proceeds in the following manner. Motor 130 is selectively energized by the storage battery stored in battery and controller pack 114 and appropriate conductors (not shown) and switching and control elements (not shown). Rotation of motor 130 results in rotation of gears in reduction gear assembly 132 and rotation of the lead screw provided in the actuator 120 thereby extending or retracting actuator 120. This linear movement results in a displacement of the cam shaft crank 146 which results in rotation of the cam shaft 140 and engagement of one of either first cam 148 or second cam 150 with a respective one of first roller 166 or second roller 170 on linkage 160. As cam shaft 140 continues to rotate, the appropriate cam 148, 150 will impart a force to linkage 160. As linkage 160 rotates, biasing assembly 200 is compressed until reaching its dead center position, defined by minimal distance between pivot 173 and pivot 205. Further, rotation of cam shaft past dead center will result in the stored compressive forces in biasing assembly 200 being imparted to and assisting rotation of linkage 160, thereby resulting in a movement of one of the first roller 166 or second roller 170 out of contact with the respective camming surface and isolation of the linkage 160 from the cam shaft 140 and actuator 120. As linkage 160 continues to rotate under the compressive forces provided by biasing assembly 200, rotation will continue until one of stop bolts 180 encounters the stop block 182.

In accordance with another aspect of the invention, also provided within the case 110 is spring assembly tool 218 which is provided with an extendable member 220, for example, a threaded fastener such as a hex bolt, movably received in an aperture in wall 219 of spring assembly tool 218 and positioned to engage a surface on spring rod guide 208. Extendable member 220 is provided with an end surface 221 which, when the biasing assembly is in the position shown by dotted lines 282, will engage a surface on the spring guide block 208. As will be appreciated by those of ordinary skill, installation of the compressive springs 202 may proceed in the following manner. First, the compressive springs 202 are installed on the spring rods 212. Next, spring rod guide 208 is installed over the ends of spring rod guides 212 and the assembly is moved to the position shown in dotted lines 282 shown in FIG. 3. Then, extendable member 220 is rotated, using a wrench for example, until surface 221 engages spring rod guide 208. Continued rotation of extendable member 220 results in compression of the springs 202 until an aperture in the spring rod guide 208 is aligned with a corresponding aperture in linkage arm 172 such that pivot 173 may be installed to pivotally secure spring rod guide 208 to linkage arm 172. Extendable member 220 is then retracted such that surface 221 is brought out of engagement with the spring rod guide 208, thereby permitting movement of the linkage 164 and biasing assembly 200. Removal of the compression springs 202 occurs by reversing the aforementioned steps.

Figure 5:
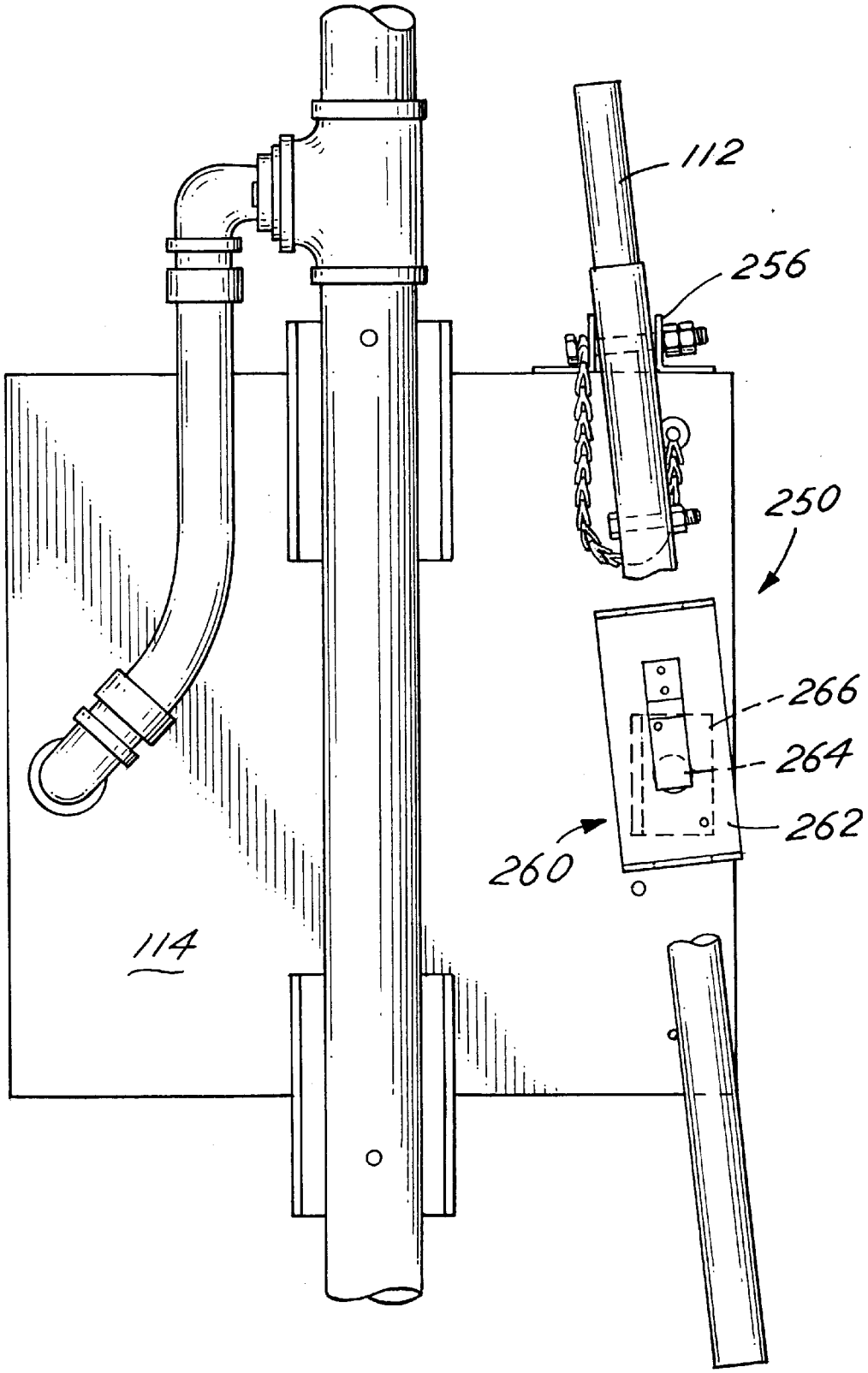
FIG. 5 is a rear view of an electric interlock according to a preferred embodiment of the present invention.
Figure 6:
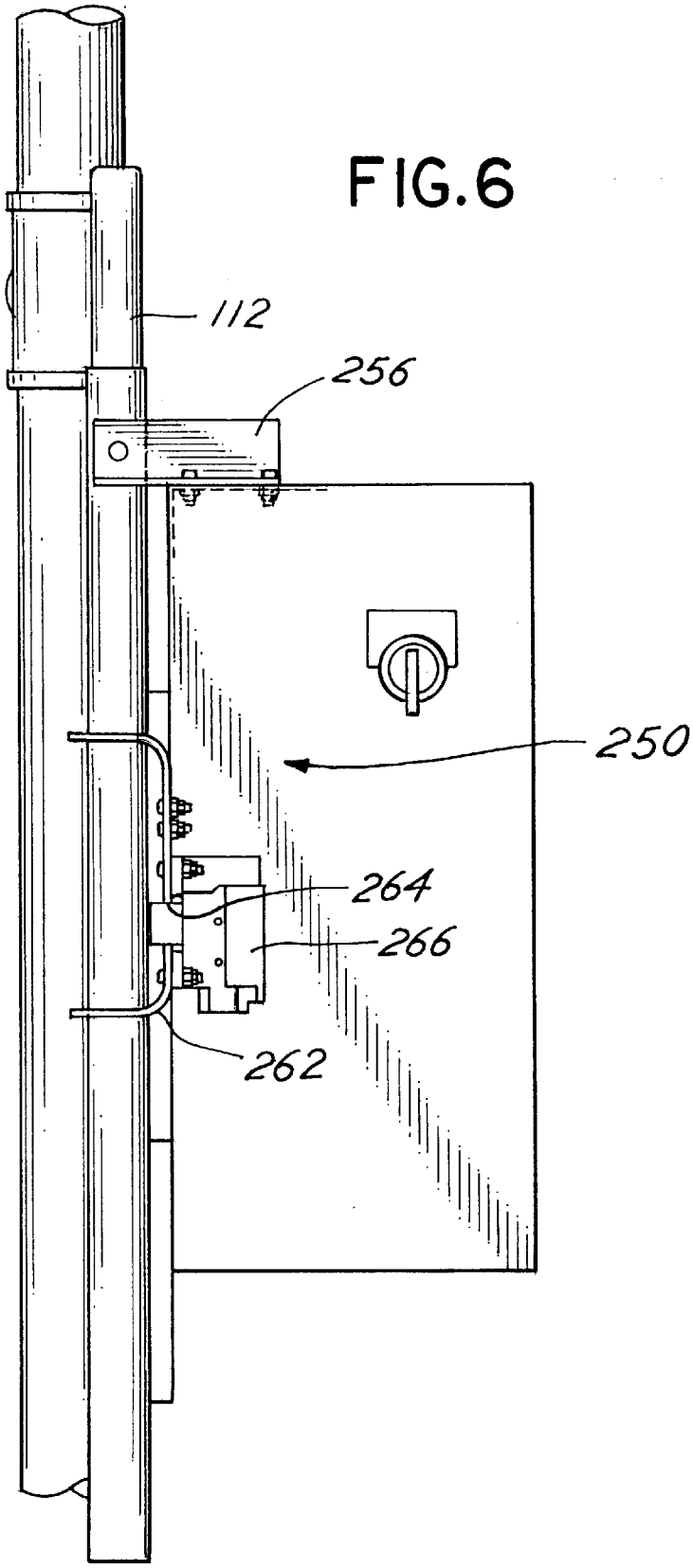
FIG. 6 is a side view of an electrical interlock according to a preferred embodiment of the present invention.

Referring now to FIGS. 5 and 6, there is illustrated a preferred embodiment of an electrical interlock in accordance with another aspect of the invention. Battery and controller pack 114 (FIG. 1) is provided on a back surface thereof with a hand lever storage assembly 250, which includes an interlock bracket 262. Interlock bracket 262 is provided with an aperture 264 through which the switching element of a micro switch 266 protrudes so as to engage the peripheral surface of the hand lever 112 when it is stored in the interlock bracket 262. A second upper bracket 256 may be provided to further secure the hand lever. Micro switch 266 is in electrical communication with the power circuit (not shown) for providing power from the storage battery and/or solar module to actuator 120. The power circuit will be an open circuit when the actuator of micro switch 266 is not engaged by hand lever 112. Hand lever 112 may be used to manually engage the operator 100 in the following manner. Hand lever 112 is removed from the hand lever storage assembly 250 and inserted into a suitable fastener disposed on the end of cam shaft 140. Hand lever 112 is then used as a lever to manually turn the cam shaft 140. As will be apparent to those of ordinary skill, the electrical interlock assembly 260 prevents energization of the motor 130 during manual operation of the cam shaft 140.

Those skilled in the art will recognize that the preferred embodiments may be altered or amended without departing from the true spirit and scope of the invention, as defined in the accompanying claims.

What is claimed is:

1. An operator for a railroad implement, the operator comprising:

an actuator;

a camshaft cooperating with the actuator, linear movement of the actuator resulting in rotation of the camshaft;

at least one cam disposed on the camshaft;

a linkage adapted to selectively engage the at least one cam, wherein the linkage rotates between first and second stop positions in response to being engaged by the at least one cam; and the camshaft and actuator being isolated from the linkage when the linkage is in the first and second stop position so as to prevent impact forces from being transmitted to the actuator.

2. The operator of claim 1, wherein the actuator includes a ball screw.

3. The operator of claim 2, further comprising a solar power source for converting solar energy into electrical energy to operate the actuator.

4. The operator of claim 2, wherein the actuator further comprises an electric motor.

5. The operator of claim 1, wherein the linkage includes a toggle.

6. The operator of claim 5, wherein the toggle further comprises at least one tapered roller adapted to selectively engage the at least one cam.

7. The operator of claim 5, further comprising a biasing assembly adapted to bias the toggle towards at least one of the first and second stop positions.

8. The operator of claim 1, wherein the camshaft is adapted cooperate with a hand lever for manual operation.

9. The operator of claim 8, further comprising an interlock for preventing energization of the actuator when the hand lever cooperates with the camshaft.

10. The operator of claim 1, wherein the actuator comprises a hydraulic cylinder.

11. A solar-powered operator for a railroad implement, the operator comprising:

an actuator including a ball screw and an electric motor adapted to drive the ball screw;

a solar power source for converting solar energy into electrical energy to operate the motor;

a camshaft cooperating with the actuator, linear movement of the ball screw resulting in rotation of the camshaft;

at least one cam disposed on the camshaft;

a linkage adapted to selectively engage the at least one cam, wherein the linkage rotates between first and second stop positions in response to being engaged by the at least one cam; and a crankshaft cooperating with the linkage for rotation therewith.

12. The solar powered operator according to claim 11, wherein the camshaft and actuator are isolated from the linkage when the linkage is in the first or second stop position so as to prevent impact forces from being transmitted to the actuator.

13. The solar powered operator according to claim 11, further comprising a reduction gear assembly cooperating between the motor and the ball screw.

14. The operator of claim 11, wherein the linkage includes a toggle.

15. The operator of claim 14, wherein the toggle further comprises at least one tapered roller adapted to selectively engage the at least one cam.

16. The operator of claim 14, further comprising a biasing assembly adapted to bias the toggle towards at least one of the first and second stop positions.

17. The operator of claim 14, wherein the camshaft is adapted cooperate with a hand lever for manual operation.

18. The operator of claim 17, further comprising an interlock for preventing energization of the actuator when the hand lever cooperates with the camshaft.

19. An operator for operating a railroad implement, the operator comprising:

an actuator for actuating the railroad implement;

an energy source for selectively energizing to the actuator;

a camshaft cooperating with the actuator, linear movement of the actuator resulting in rotation of the camshaft;

a hand lever for manually operating the camshaft;

an interlock for preventing energization of the actuator when the camshaft is manually operated with the hand lever.

20. An operator for operating railroad implement, the operator comprising:

a housing;

an actuator in the housing for actuating the railroad implement;

a linkage operatively associated with the actuator;

a bias assembly cooperating with the linkage, the biasing assembly including at least one spring;

a spring compression tool affixed to the housing and adapted to compress the at least one spring to facilitate installation and removal thereof.

21. The operator of claim 20, wherein the spring assembly tool further comprises an angled bracket affixed to a case of the operator, and an extendable member arranged to extend and retract with respect to the angled bracket.

22. The operator according to claim 20, wherein said biasing assembly further comprises a spring rod and a spring rod guide, the extendable member of the spring assembly tool being adapted to engage the spring rod guide.

* * * * *